US011641080B2

(12) United States Patent
Kimura

(10) Patent No.: US 11,641,080 B2
(45) Date of Patent: May 2, 2023

(54) CONNECTOR FORMED WITH CONNECTOR BODY HAVING PREDETERMINED SURFACE FACING DOWNWARD AND A CABLE-HOLDING PORTION INTEGRATED UNDER PROPER ARRANGEMENT

(71) Applicant: Japan Aviation Electronics Industry, Limited, Tokyo (JP)

(72) Inventor: Masaki Kimura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 17/365,115

(22) Filed: Jul. 1, 2021

(65) Prior Publication Data

US 2022/0085553 A1 Mar. 17, 2022

(30) Foreign Application Priority Data

Sep. 11, 2020 (JP) ..... JP2020-152945

(51) Int. Cl.
*H01R 13/658* (2011.01)
*H01R 13/6581* (2011.01)
*H01R 43/24* (2006.01)
*H01R 13/504* (2006.01)

(52) U.S. Cl.
CPC ..... *H01R 13/6581* (2013.01); *H01R 13/504* (2013.01); *H01R 43/24* (2013.01)

(58) Field of Classification Search
CPC ... H01R 13/6581; H01R 13/504; H01R 43/24
USPC ..... 439/607.58
See application file for complete search history.

(56) References Cited

U.S. PATENT DOCUMENTS 5,273,459 A * 12/1993 Davis ..... H01R 13/6593 439/607.48
7,494,384 B2 * 2/2009 Friedhof ..... H01R 13/621 439/607.41
7,670,154 B2 * 3/2010 Yu ..... H01R 13/65912 439/98
8,002,574 B1 * 8/2011 Yi ..... H01R 13/582 439/455

(Continued)

FOREIGN PATENT DOCUMENTS

CN 104752898 A * 7/2015 ..... H01R 13/2442
JP 2020-077524 A 5/2020
WO 2016/051489 A 8/2017

*Primary Examiner* — Peter G Leigh
(74) *Attorney, Agent, or Firm* — Collard & Roe, P.C.

(57) ABSTRACT

A harness comprises a connector body, a cable and a cable-holding portion which holds the cable. The connector body comprises a base portion. The cable is connected to the connector body. The cable has an end portion received in the base portion and a main portion extending rearward from the end portion. The cable-holding portion is formed with a recessed portion which opens at least downward in the upper-lower direction (Z-direction). The base portion has an interference portion. The recessed portion and the interference portion are located at opposite sides of the harness, respectively, in the lateral direction (Y-direction). The recessed portion is, at least in part, located at a position same as that of the interference portion in the front-rear direction (X-direction). The recessed portion is, at least in part, located at a position same as that of the interference portion in the upper-lower direction.

11 Claims, 12 Drawing Sheets

(56) References Cited

U.S. PATENT DOCUMENTS

| | | | | |
|---|---|---|---|---|
| 8,388,378 | B2 * | 3/2013 | Ratzlaff | H01R 13/648<br>439/607.01 |
| 9,515,427 | B2 * | 12/2016 | Wu | H01R 13/7175 |
| 9,583,889 | B2 * | 2/2017 | Wu | H01R 13/6593 |
| 9,620,904 | B2 * | 4/2017 | Kao | H01R 13/6461 |
| 9,819,128 | B2 * | 11/2017 | Zhou | H01R 13/7172 |
| 9,831,590 | B2 | 11/2017 | Onimoto | |
| 10,177,503 | B2 * | 1/2019 | Zou | H01R 12/707 |
| 10,784,629 | B2 | 9/2020 | Yamaguchi et al. | |
| 2010/0317220 | A1 * | 12/2010 | Shen | H01R 12/775<br>439/374 |
| 2020/0194931 | A1 * | 6/2020 | Shimomaki | H01R 13/422 |

* cited by examiner

CONNECTOR FORMED WITH CONNECTOR BODY HAVING PREDETERMINED SURFACE FACING DOWNWARD AND A CABLE-HOLDING PORTION INTEGRATED UNDER PROPER ARRANGEMENT

CROSS REFERENCE TO RELATED APPLICATIONS

This application is based on and claims priority under 35 U.S.C. § 119 to Japanese Patent Application No. JP 2020-152945 filed Sep. 11, 2020, the content of which is incorporated herein in its entirety by reference.

BACKGROUND OF THE INVENTION

This invention relates to a harness configured to be connected to an object such as a mating connector.

For example, this type of harness is disclosed in JPA 2020-77524 (Patent Document 1), the content of which is incorporated herein by reference.

Referring to FIG. 22, Patent Document 1 discloses a harness 90 which comprises a connector (connector body) 92, a cable 94 and a cable-holding portion 96. The cable 94 is connected to the connector body 92 and extends rearward, i.e. in the negative X-direction, from the connector body 92. The cable-holding portion 96 holds the cable 94. The cable 94 is connected to the connector body 92. Thereafter, the cable-holding portion 96 is formed so as to extend across the connector body 92 and the cable 94.

When a cable-holding portion such as that of Patent Document 1 is formed, a connector body connected to a cable is usually arranged so that a predetermined surface thereof faces downward. The thus-arranged connector body is partially received in a lower die. However, in some instances, the connector body has a vertically asymmetrical structure because of reasons such as asymmetrical pin assignment of terminals. The thus-formed connector body is also required to be formed with a cable-holding portion under a proper arrangement in which a predetermined surface of the connector body faces downward.

SUMMARY OF THE INVENTION

It is therefore an object of the present invention to provide a harness having a structure which is simple and enables a visual inspection on whether the connector body is properly arranged or not upon formation of the cable-holding portion.

An aspect of the present invention provides a harness configured to be connected to an object. The harness comprises a connector body, a cable and a cable-holding portion. The connector body comprises a base portion and a fit portion. The fit portion projects forward in a front-rear direction from the base portion and is mateable with the object along the front-rear direction. The cable is connected to the connector body. The cable has an end portion and a main portion. The end portion is received in the base portion. The main portion extends rearward from the end portion. The cable-holding portion is formed so as to extend across the base portion and the main portion and holds the cable. The cable-holding portion is formed with a recessed portion. The recessed portion opens at least downward in an upper-lower direction perpendicular to the front-rear direction. The base portion of the connector body has an interference portion. The recessed portion and the interference portion are located at opposite sides of the harness, respectively, in a lateral direction perpendicular to both the front-rear direction and the upper-lower direction. The recessed portion is, at least in part, located at a position same as that of the interference portion in the front-rear direction. The recessed portion is, at least in part, located at a position same as that of the interference portion in the upper-lower direction.

The recessed portion according to an aspect of the present invention is a mark where a pin of a die which is used upon formation of the cable-holding portion is pulled out. When the connector body is turned upside-down, the interference portion of the connector body is moved to a position at which the recessed portion of the connector body is previously located. If the connector body is arranged upside-down upon formation of the cable-holding portion, the interference portion is brought into abutment with the pin of the die, and the connector body is lifted up from the die. Thus, according to an aspect of the present invention, only one interference portion provided on the connector body enables visual inspection upon formation of the cable holding portion on whether the connector body is arranged upside-down or not. As described above, an aspect of the present invention can provide a harness having a structure which is simple and enables a visual inspection on whether the connector body is properly arranged or not upon formation of the cable-holding portion.

An appreciation of the objectives of the present invention and a more complete understanding of its structure may be had by studying the following description of the preferred embodiment and by referring to the accompanying drawings.

Figure 1:
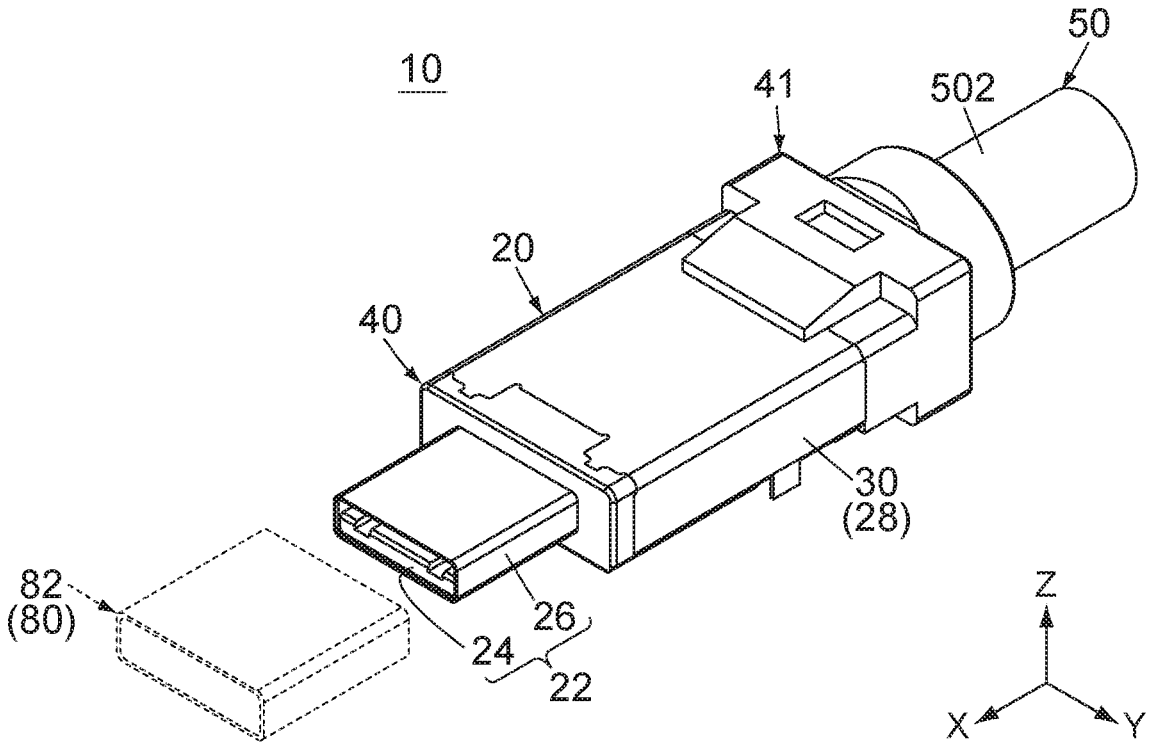
FIG. 1 is a perspective view showing a harness according to an embodiment of the present invention, wherein an outline of a mating fit portion of a mating connector, which is an object configured to be connected to the harness, is illustrated in dashed line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
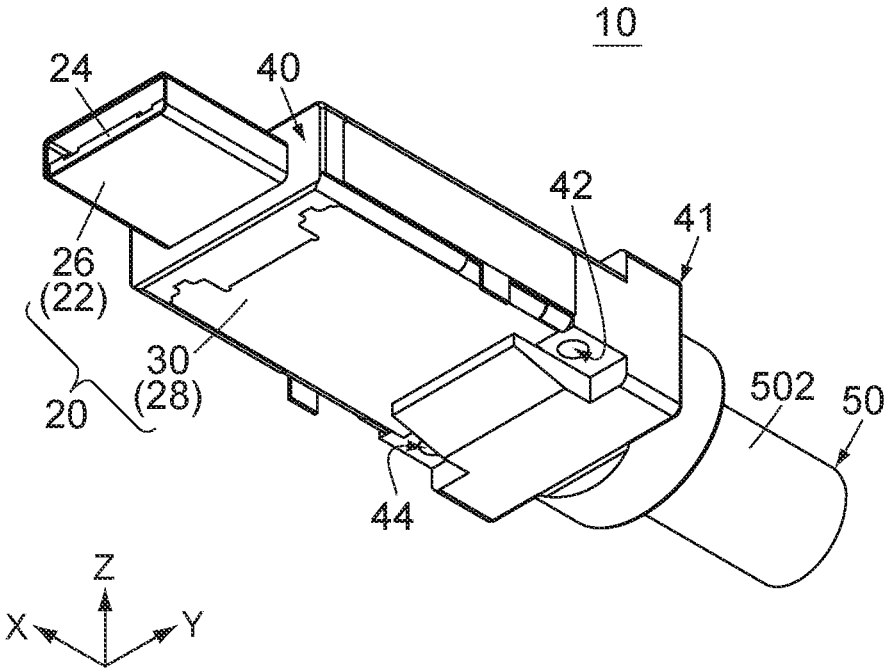
FIG. 2 is another perspective view showing the harness of FIG. 1.
Figure 3:
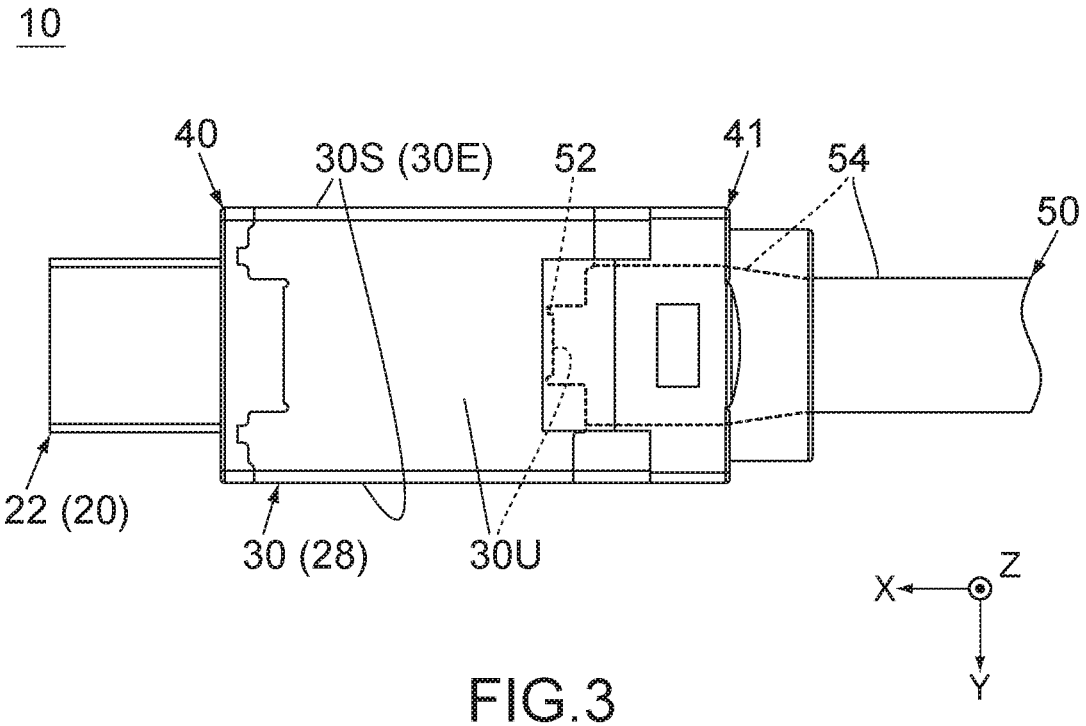
FIG. 3 is a top view showing the harness of FIG. 1, wherein a hidden outline of a cable and a hidden outline of a shell are illustrated with dashed line.
Figure 6:
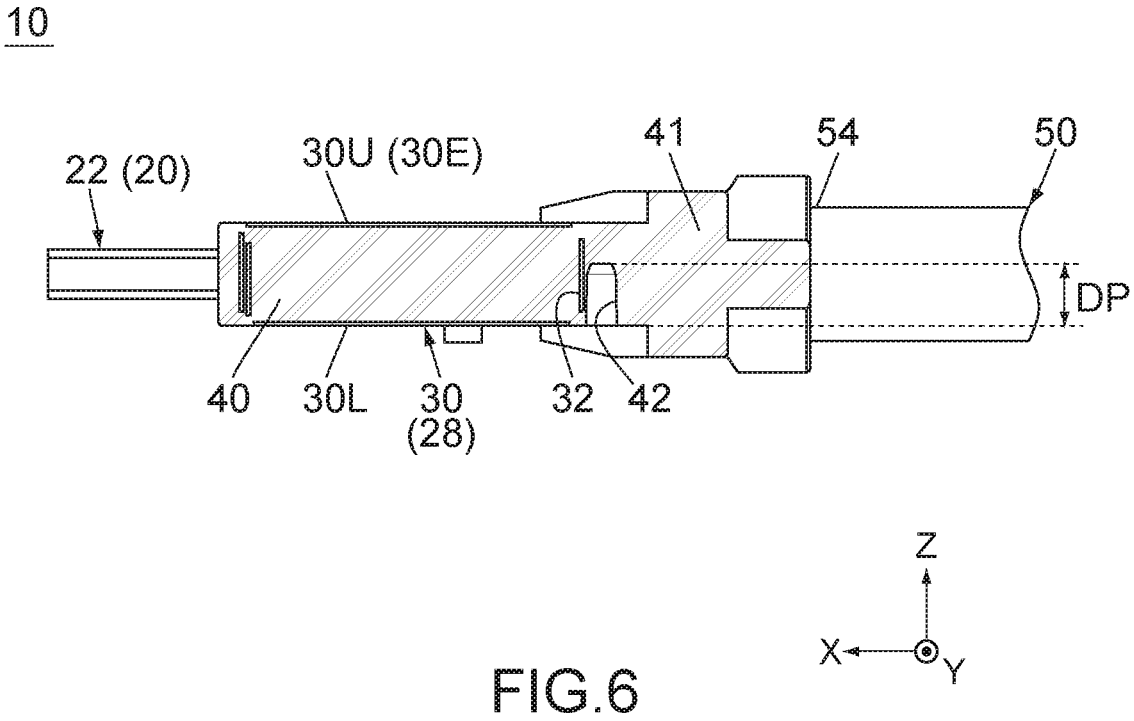
FIG. 6 is a cross-sectional view showing the harness of FIG. 5, taken along line VI-VI.

Referring to FIG. 1, a harness 10 according to an embodiment of the present invention is a cable harness configured to be connected to an object 80 such as a mating connector. As shown in FIGS. 1 and 2, the harness 10 of the present embodiment comprises a connector body 20, a cable 50 and a mold member 40 made of insulator. The cable 50 is connected to the connector body 20. The mold member 40 partially covers the connector body 20 and the cable 50. The mold member 40 has a cable-holding portion 41. Referring to FIG. 6, the mold member 40 includes a front part and the cable-holding portion 41. The front part is located at a front side (positive X-side) of the mold member 40 in a front-rear direction (X-direction). The cable-holding portion 41 is located at a rear side (negative X-side) of the mold member 40. The harness 10 comprises the cable-holding portion 41 which is formed as described above.

Referring to FIG. 1, the harness 10 of the present embodiment comprises only the connector body 20, the cable 50 and the mold member 40 which includes the cable-holding portion 41. However, the present invention is not limited thereto. For example, the harness 10 may comprise an outer housing (not shown) in addition to the members described above. The outer housing may accommodate the connector body 20.

The cable 50 of the present embodiment comprises a plurality of conductive wires (not shown) and a jacket 502 made of insulator. Each of the conductive wires comprises a core wire (not shown) made of conductor and a coat (not shown) made of insulator. Each of the core wires is coated with the coat. The jacket 502 bundles and covers the conductive wires. The cable 50 of the present embodiment has the aforementioned structure. However, the structure of the cable 50 of the present invention is not specifically limited.

Referring to FIG. 1, one of opposite ends of the cable 50 is connected to the connector body 20. An unillustrated remaining one of the opposite ends of the cable 50 is connected to an electronic device (not shown). The object 80 is incorporated in a mating electronic device (not shown). When the harness 10 is connected to the object 80, the electronic device and the mating electronic device are electrically connected with each other. However, the present invention is not limited thereto but can be applicable to various harnesses.

Figure 7:
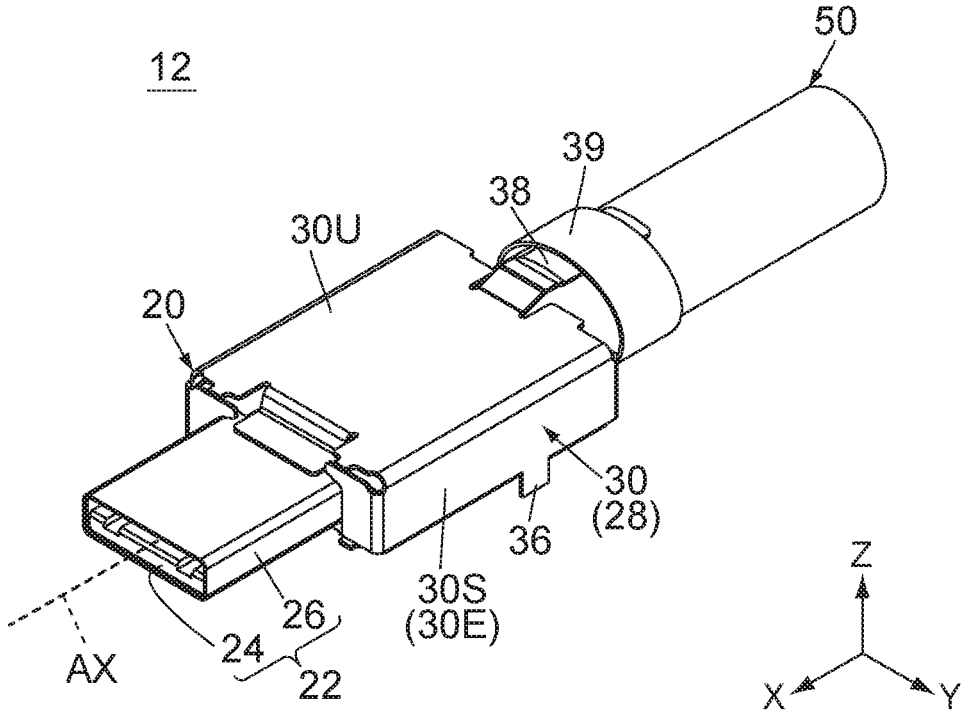
FIG. 7 is a perspective view showing an intermediate structure formed of a connector body and the cable of the harness of FIG. 1, wherein an imaginary central axis of the connector body is illustrated with dashed line.

Referring to FIGS. 1 and 7, the harness 10 of the present embodiment is fabricated by forming the mold member 40 on an intermediate structure 12. The intermediate structure 12 has a structure same as that of the harness 10, except that the intermediate structure 12 does not comprise the mold member 40. In other words, the intermediate structure 12 comprises the connector body 20 and the cable 50. Hereafter, explanation will be made about the intermediate structure 12 of the present embodiment.

As shown in FIG. 7, the connector body 20 comprises a base portion 28 and a fit portion 22. The base portion 28 and the fit portion 22 of the present embodiment are formed separately from each other and thereafter fixed to each other. The fit portion 22 projects forward in the X-direction, i.e. in the positive X-direction, from the base portion 28. In other words, the fit portion 22 is a front part of the connector body 20, and the base portion 28 is a rear part of the connector body 20. The connector body 20 of the present embodiment has only the base portion 28 and the fit portion 22. However, the present invention is not limited thereto. For example, the connector body 20 may further comprise another member in addition to the base portion 28 and the fit portion 22.

Referring to FIG. 1, the fit portion 22 is mateable with the object 80 along the X-direction. The object 80 of the present embodiment has a mating fit portion 82. The fit portion 22 is received in the mating fit portion 82 under a mated state where the connector body 20 is mated with the object 80. However, the present invention is not limited thereto. For example, the fit portion 22 may receive the mating fit portion 82 under the mated state.

Referring to FIG. 7, the fit portion 22 of the present embodiment comprises a holding member 24 made of insulator, a front shell 26 made of metal and a plurality of terminals (not shown) which correspond to the core wires (not shown) of the cable 50, respectively. The holding member 24 holds the terminals. The front shell 26 opens forward and rearward, i.e. in the negative X-direction. The front shell 26 entirely encloses and electro-magnetically shields the holding member 24 and the terminals in a vertical plane (YZ-plane) perpendicular to the X-direction.

The front shell 26, which is formed as described above, defines an outline of the fit portion 22. The front shell 26 has a symmetric shape with respect to a horizontal plane (XY-plane) perpendicular to the YZ-plane. Moreover, the shape of the front shell 26 is not changed when the front shell 26 is turned upside-down in an upper-lower direction (Z-direction) perpendicular to the X-direction. In other words, when the front shell 26 is rotated by 180 degrees about a central axis AX which extends along the X-direction, the shape of the front shell 26 is same as that of the front shell 26 before the rotation. Hereafter, such shape (outline) is referred to as "180-degree rotationally symmetrical shape (outline) with respect to the central axis AX". The shape (outline) which is not 180-degree rotational symmetry with respect to the central axis AX is referred to as "180-degree rotationally asymmetrical shape (outline) with respect to the central axis AX".

According to the definition described above, the front shell 26 of the present embodiment has a 180-degree rotationally symmetrical shape with respect to the central axis AX. Thus, the fit portion 22 of the present embodiment has a 180-degree rotationally symmetrical outline with respect to the central axis AX. More specifically, the fit portion 22 of the present embodiment has a rectangular outline in the YZ-plane. However, the present invention is not limited thereto. For example, the fit portion 22 may have a track-shaped outline in the YZ-plane or may have a circular outline in the YZ-plane. Moreover, the fit portion 22 may have a 180-degree rotationally asymmetrical outline with respect to the central axis AX.

Referring to FIGS. 7 to 10, the base portion 28 of the present embodiment comprises a shell 30 made of conductor. The shell 30 of the present embodiment is formed of two metal plates which are combined to each other. Each of the metal plates is formed with bends. The shell 30 has an upper plate 30U, a lower plate 30L and two side plates 30S. The upper plate 30U is located at an upper side (positive Z-side) of the shell 30 in the Z-direction. The lower plate 30L is located at a lower side (negative Z-side) of the shell 30. The upper plate 30U and the lower plate 30L extend along the XY-plane in parallel to each other. The side plates 30S are located at opposite sides of the shell 30, respectively, in a lateral direction (Y-direction) perpendicular to both the X-direction and the Z-direction and extend in parallel to each other along a perpendicular plane (XZ-plane) perpendicular to the Y-direction.

The upper plate 30U, the lower plate 30L and the side plates 30S are connected to each other to form an outer circumference portion 30E. The outer circumference portion 30E almost entirely encloses and electro-magnetically shields the inside of the outer circumference portion 30E in the YZ-plane. The outer circumference portion 30E opens forward and rearward. The shell 30 of the present embodiment has the aforementioned structure. However, the structure of the shell 30 of the present invention is not specifically limited. Moreover, the shell 30 may be a single metal plate with bends.

Figure 8:
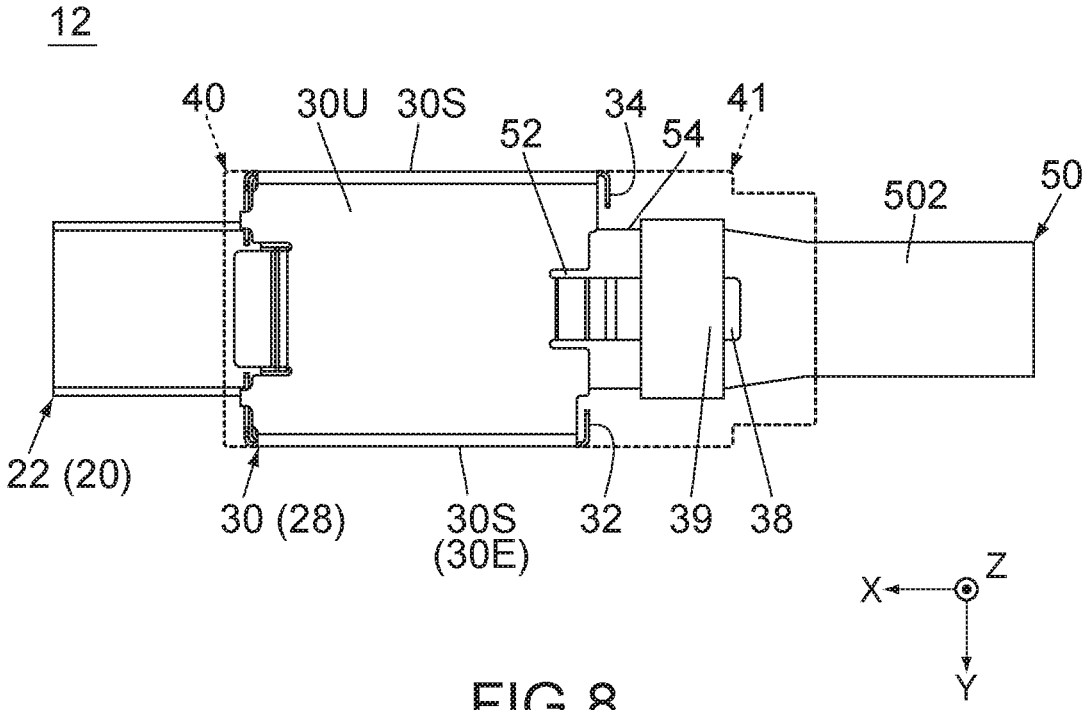
FIG. 8 is a top view showing the intermediate structure of FIG. 7, wherein an outline of a mold member of the harness is illustrated with dashed line.
Figure 10:
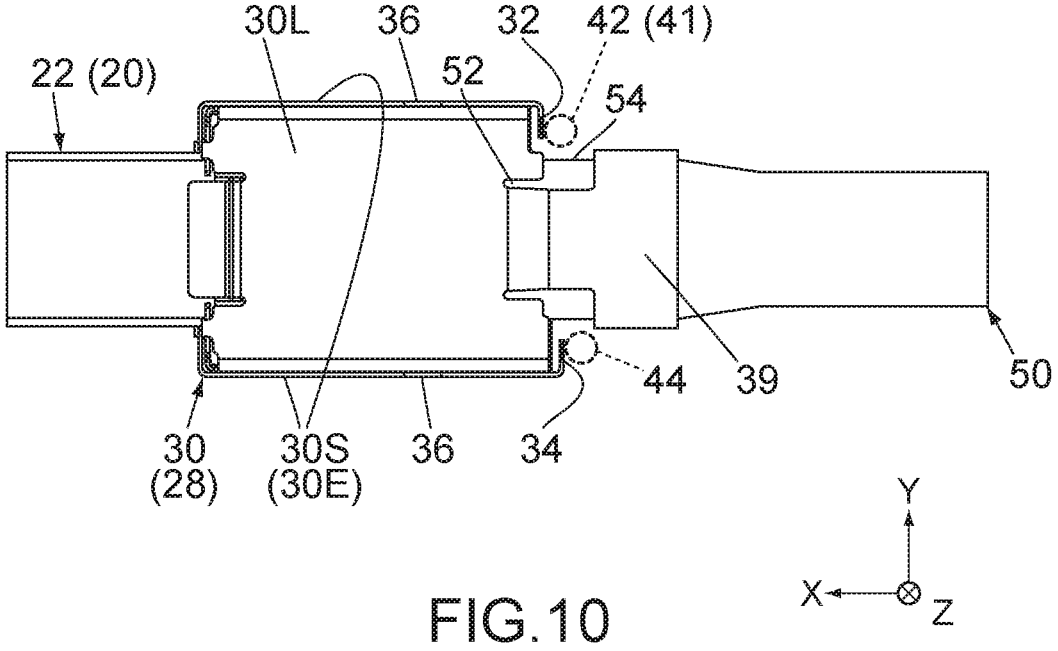
FIG. 10 is a bottom view showing the intermediate structure of FIG. 7, wherein outlines of the first recessed portion and the second recessed portion of a cable-holding portion of the harness are illustrated with dashed line.

As shown in FIGS. 8 and 10, the base portion 28 of the present embodiment has a first positioning portion 32 and a second positioning portion 34. As described later, the first positioning portion 32 and the second positioning portion 34 work as positioning portions when the mold member 40 (see FIG. 1) is formed on the intermediate structure 12. The first positioning portion 32 and the second positioning portion 34 of the present embodiment are provided so as to correspond to the two side plates 30S, respectively. Each of the first positioning portion 32 and the second positioning portion 34 is integrally formed with the corresponding side plate 30S.

Each of the first positioning portion 32 and the second positioning portion 34 of the present embodiment slightly extends rearward from a rear edge (negative X-side edge) of the corresponding side plate 30S and then extends inward in the Y-direction. Each of the first positioning portion 32 and the second positioning portion 34 has an L-like shape in the XY-plane. No part of the intermediate structure 12 is located rearward of each of the first positioning portion 32 and the second positioning portion 34. In other words, a space is located rearward of each of the first positioning portion 32 and the second positioning portion 34.

The first positioning portion 32 and the second positioning portion 34 are located at the opposite sides of the shell 30 in the Y-direction, respectively. The first positioning portion 32 and the second positioning portion 34 are located at positions different from each other in the X-direction. More specifically, a predetermined side plate 30S, which is one of the side plates 30S, has a rear edge which is located rearward of another rear edge of the other side plate 30S. The second positioning portion 34 is provided on the predetermined side plate 30S. Thus, the first positioning portion 32 of the present embodiment is located forward of the second positioning portion 34.

Each of the first positioning portion 32 and the second positioning portion 34 of the present embodiment is a part of the shell 30 and has the aforementioned structure. However, the present invention is not limited thereto. For example, each of the first positioning portion 32 and the second positioning portion 34 may be a member formed separately from the shell 30.

Figure 9:
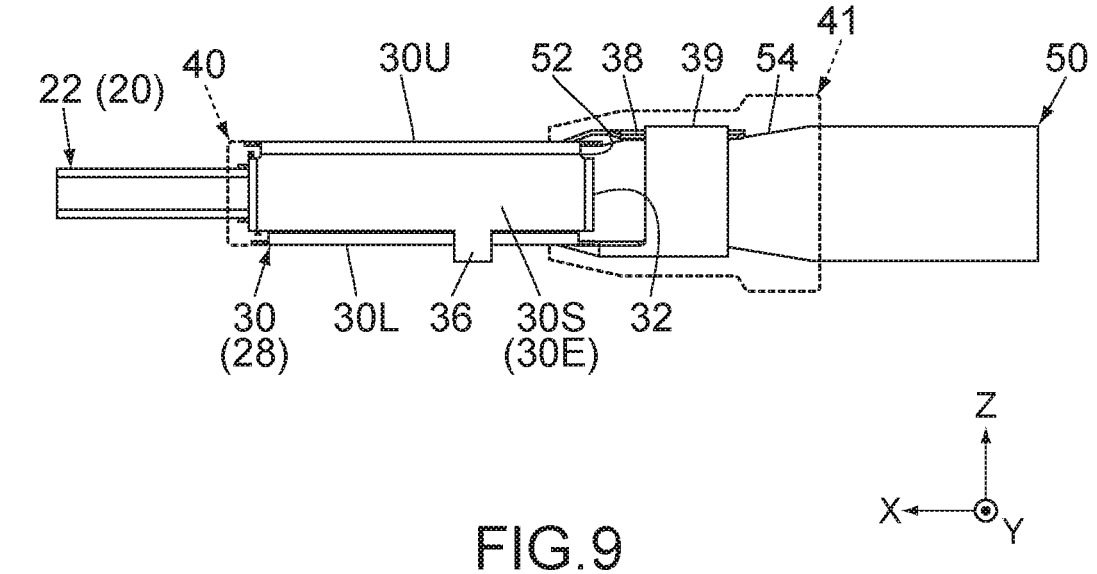
FIG. 9 is a side view showing the intermediate structure of FIG. 7, wherein an outline of the mold member is illustrated with dashed line.

Referring to FIGS. 7, 9 and 10, the base portion 28 of the present embodiment has two projections 36. For example, the projections 36 can be used to position the connector body 20 when the connector body 20 is accommodated in the outer housing (not shown). The projections 36 of the present embodiment are provided so as to correspond to the two side plates 30S, respectively. Each of the projections 36 is integrally formed with the corresponding side plate 30S.

The projections 36 are located at the opposite sides of the shell 30 in the Y-direction. Each of the projections 36 is located at the middle of the corresponding side plate 30S in the X-direction. Each of the projections 36 extends downward, i.e. in the negative Z-direction, slightly beyond the lower plate 30L from a lower edge (negative Z-side edge) of the corresponding side plate 30S.

Each of the projections 36 of the present embodiment is a part of the shell 30 and has the aforementioned structure. However, the present invention is not limited thereto. For example, each of the projections 36 may be a member formed separately from the shell 30. Moreover, the projections 36 may be provided as necessary.

Referring to FIGS. 7 to 10, the base portion 28 of the present embodiment has an assigned portion 38 and a crimp portion 39. The assigned portion 38 and the crimp portion 39 is used to attach the cable 50 to the connector body 20. Referring to FIGS. 7 and 8, the assigned portion 38 of the present embodiment is integrally formed with the upper plate 30U. The assigned portion 38 extends rearward from a rear edge of the upper plate 30U. Referring to FIG. 10, the crimp portion 39 of the present embodiment is integrally formed with the lower plate 30L. The crimp portion 39 extends rearward from a rear edge of the lower plate 30L.

Referring to FIGS. 7 and 8, each of the assigned portion 38 and the crimp portion 39 of the present embodiment is a part of the shell 30 and has the aforementioned structure. However, the present invention is not limited thereto. For example, each of the assigned portion 38 and the crimp portion 39 may be a member formed separately from the shell 30. Moreover, the assigned portion 38 and the crimp portion 39 may be provided as necessary.

Referring to FIG. 7, the shell 30 which is formed as described above defines an outline of the base portion 28. The shell 30 has an asymmetric shape with respect to the XY-plane. Moreover, the shell 30 has a 180-degree rotationally asymmetrical shape with respect to the central axis AX. Thus, the base portion 28 of the present embodiment has a 180-degree rotationally asymmetrical outline with respect to the central axis AX.

Referring to FIGS. 7 to 10, the front shell 26 of the fit portion 22 is fixed to a front end (positive X-side end) of the shell 30 of the base portion 28 via soldering, etc. The front shell 26 is located inward of the outer circumference portion 30E of the shell 30 in the YZ-plane. The base portion 28 comprises a connection structure (not shown) in addition to the shell 30. The connection structure is located inside the outer circumference portion 30E. Each of the terminals (not shown) of the fit portion 22 has a rear end (negative X-side end) which is connected to the connection structure.

Referring to FIG. 8, the cable 50 has an end portion 52 and a main portion 54. The end portion 52 is received in the base portion 28. In detail, the end portion 52 is received inside the outer circumference portion 30E of the shell 30 and is almost entirely enclosed by the outer circumference portion 30E in the YZ-plane. Each of the core wires (not shown) of the end portion 52 is exposed from the jacket 502 and the coat (not shown) and is connected to the connection structure (not shown) of the base portion 28. The connection structure connects each of the terminals (not shown) to the corresponding core wire.

Referring to FIG. 1, the core wires (not shown) of the cable 50 are connected with the terminals (not shown) of the fit portion 22, respectively, through the connection structure (not shown) of the base portion 28. Under the mated state, front ends of the terminals are connected to mating terminals (not shown) of the object 80, respectively, so that the electronic device (not shown) connected to the harness 10 is electrically connected with the mating electronic device (not shown) provided with the object 80. However, the present invention is not limited thereto. For example, the connection structure for connecting the core wires of the cable 50 to the mating terminals can be variously modified as necessary.

Referring to FIG. 8, the main portion 54 of the cable 50 extends rearward from the end portion 52. The assigned portion 38 of the shell 30 is placed on the main portion 54. The crimp portion 39 of the shell 30 is wound around and crimps the main portion 54 while the assigned portion 38 is partially located between the crimp portion 39 and the main portion 54. The cable 50 of the present embodiment is attached to the connector body 20 as described above. However, the attachment method of the cable 50 to the connector body 20 of the present invention is not specifically limited.

Hereafter, explanation will be made about the mold member 40 and the cable-holding portion 41 of the present embodiment.

Referring to FIGS. 3, 6, 8 and 9, as previously described, the mold member 40 of the present embodiment is a unitary member which includes the cable-holding portion 41 as a part thereof and is formed at the same time as the formation of the cable-holding portion 41. More specifically, after the intermediate structure 12 is fabricated, material such as resin is molded to form the mold member 40. The mold member 40 partially covers the intermediate structure 12. In detail, the mold member 40 is filled in the shell 30 of the connector body 20 and partially covers the shell 30 and a main portion 54 of the cable 50. The mold member 40 illustrated in FIG. 6 continuously extends in the X-direction over a range including the front end and a rear end of the shell 30. However, the present invention is not limited thereto. For example, the mold member 40 may be partially filled in the shell 30.

The cable-holding portion 41 of the present embodiment is a rear part of the mold member 40. The cable-holding portion 41 continuously extends in the X-direction and partially covers the shell 30 and a main portion 54 of the cable 50. In other words, the cable-holding portion 41 is formed so as to extend across the shell 30 and the main portion 54. More specifically, the cable-holding portion 41 is formed so as to extend across the base portion 28 and the main portion 54 and holds the cable 50.

Referring to FIGS. 8 and 9, the cable-holding portion 41 of the present embodiment continuously extends from a front part of the mold member 40. The thus-formed cable-holding portion 41 securely holds and protects the cable 50. However, the present invention is not limited thereto. For example, the cable-holding portion 41 may be formed separately from the front part of the mold member 40. Moreover, the front part of the mold member 40 may be formed as necessary.

As shown in FIG. 2, the cable-holding portion 41 of the present embodiment is formed with a first recessed portion 42 and a second recessed portion 44. The first recessed portion 42 and the second recessed portion 44 of the present embodiment are formed upon molding the mold member 40. Hereafter, explanation will be made about the forming method of the mold member 40 according to the present embodiment.

Figure 11:
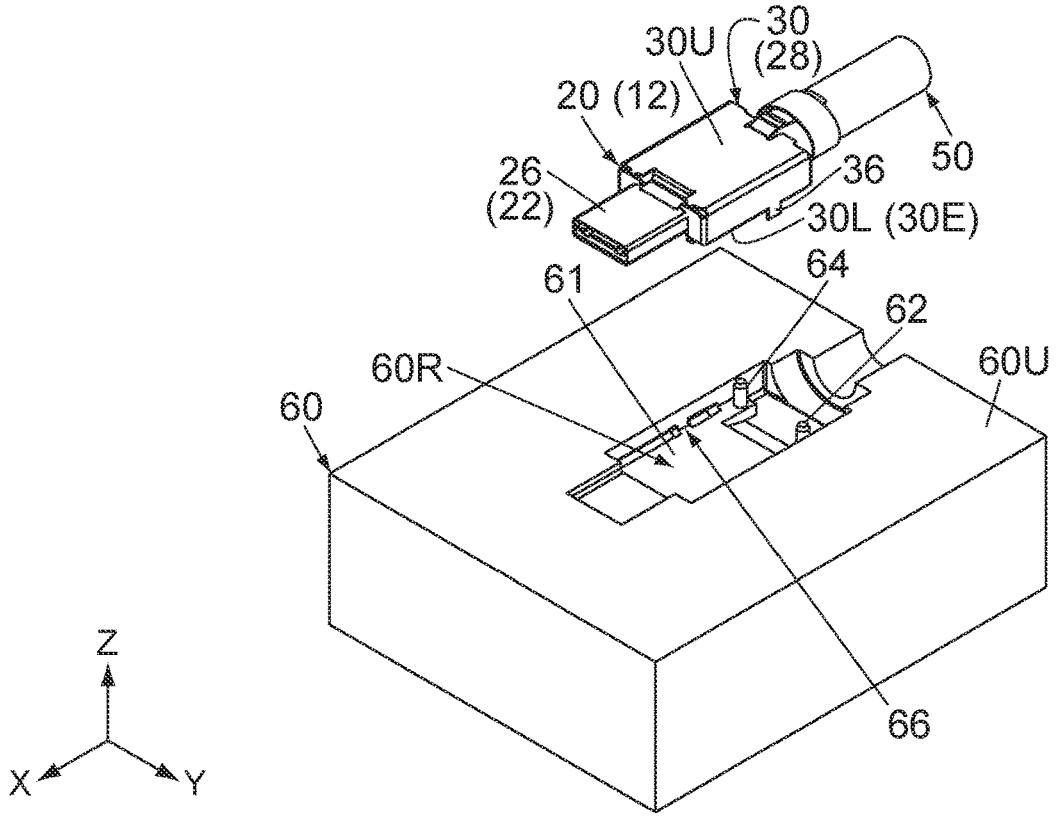
FIG. 11 is a perspective view showing the intermediate structure of FIG. 7 and a lower die.
Figure 12:
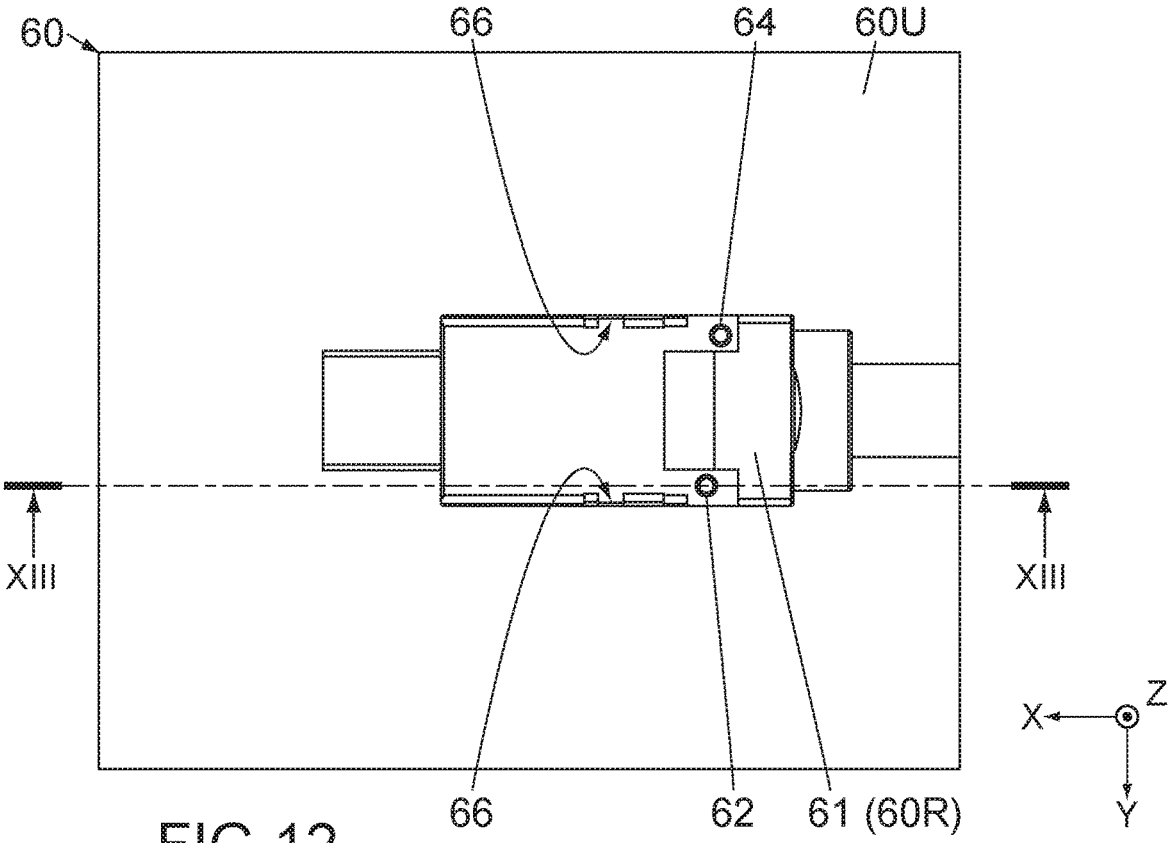
FIG. 12 is a top view showing the lower die of FIG. 11.
Figure 13:
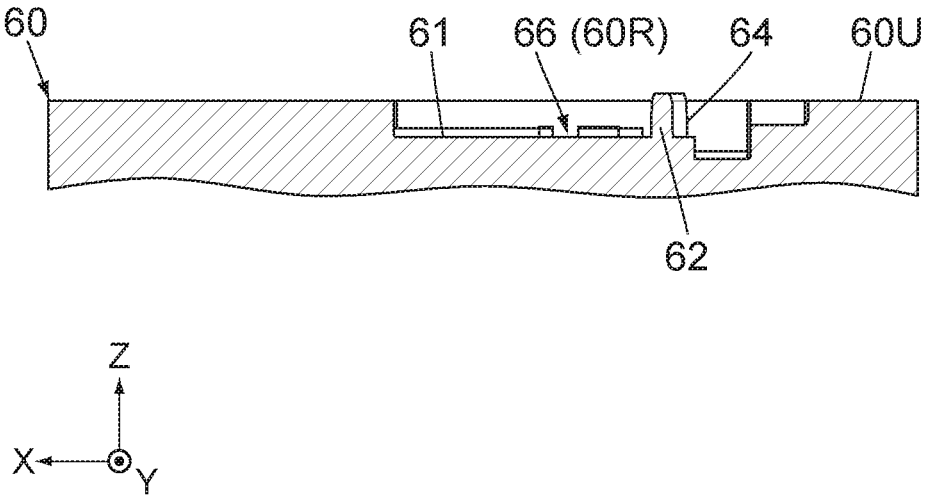
FIG. 13 is a cross-sectional view showing the lower die of FIG. 12, taken along line XIII-XIII.
Figure 14:
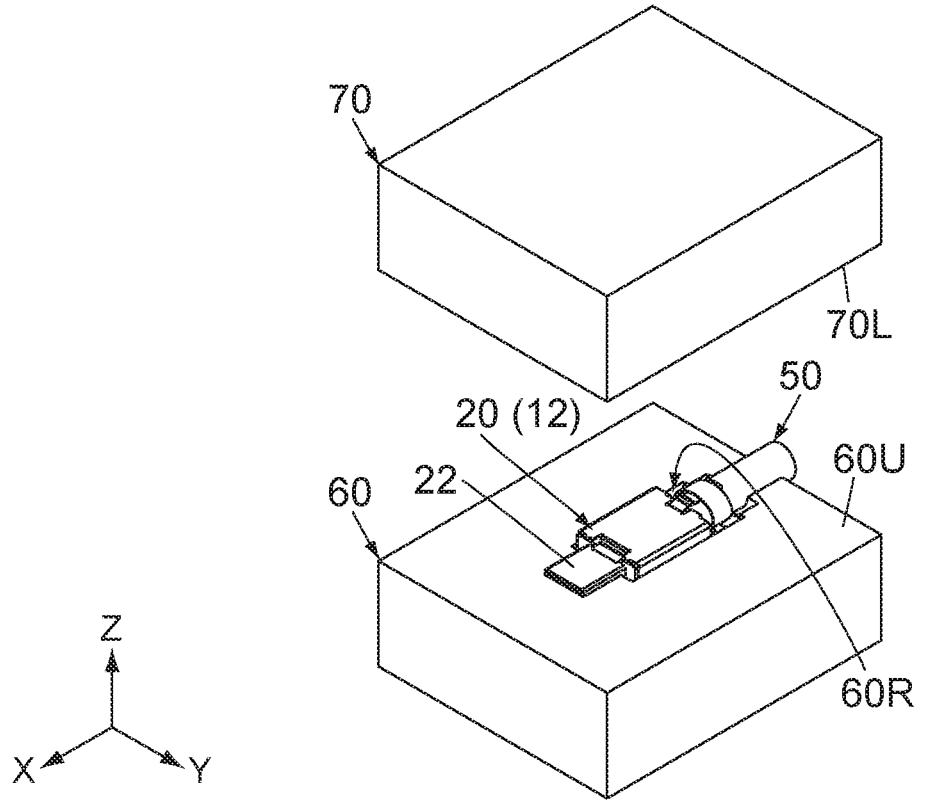
FIG. 14 is a perspective view showing the intermediate structure and the lower die of FIG. 11 together with an upper die, wherein the connector body of the intermediate structure is properly arranged and is partially received in the lower die.

Referring to FIG. 14, the mold member 40 (see FIG. 1) of the present embodiment is formed by using two dies, namely a lower die 60 and an upper die 70. Referring to FIGS. 11 to 13, the lower die 60 has an upper surface 60U. The upper surface 60U is located at an upper end (positive Z-side end) of the lower die 60 and extends along the XY-plane. The lower die 60 is formed with a receiving portion 60R. The receiving portion 60R is a recess which is recessed downward from the upper surface 60U. The receiving portion 60R is formed with a bottom surface 61.

Referring to FIG. 11, the receiving portion 60R has a shape which can entirely receive a lower part of the connector body 20. The receiving portion 60R has a size in the Y-direction which is designed so that the receiving portion 60R can receive the front shell 26 of the connector body 20 and the outer circumference portion 30E of the shell 30 with no substantial gap. In addition, the bottom surface 61 of the receiving portion 60R has a shape which corresponds to a lower outline of the connector body 20. For example, the bottom surface 61 is formed with two indents 66 which correspond to the projections 36 of the shell 30, respectively. Each of the indents 66 is formed so that the corresponding projection 36 can be received therein. When the connector body 20 is received in the receiving portion 60R in a proper arrangement in which the lower plate 30L of the shell 30 faces downward, the projections 36 are received in the indents 66, respectively, and the lower plate 30L is brought into contact with the bottom surface 61.

Figure 15:
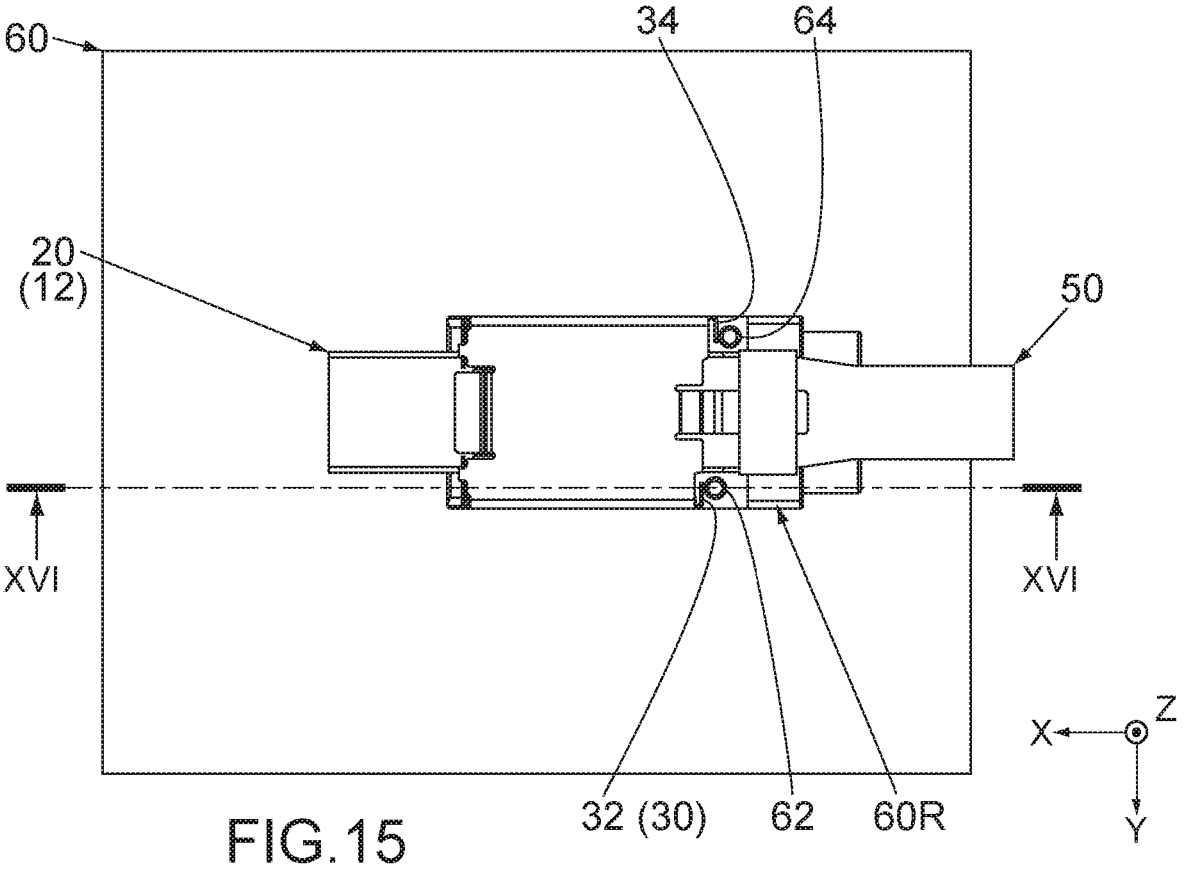
FIG. 15 is a top view showing the intermediate structure and the lower die of FIG. 14.
Figure 16:
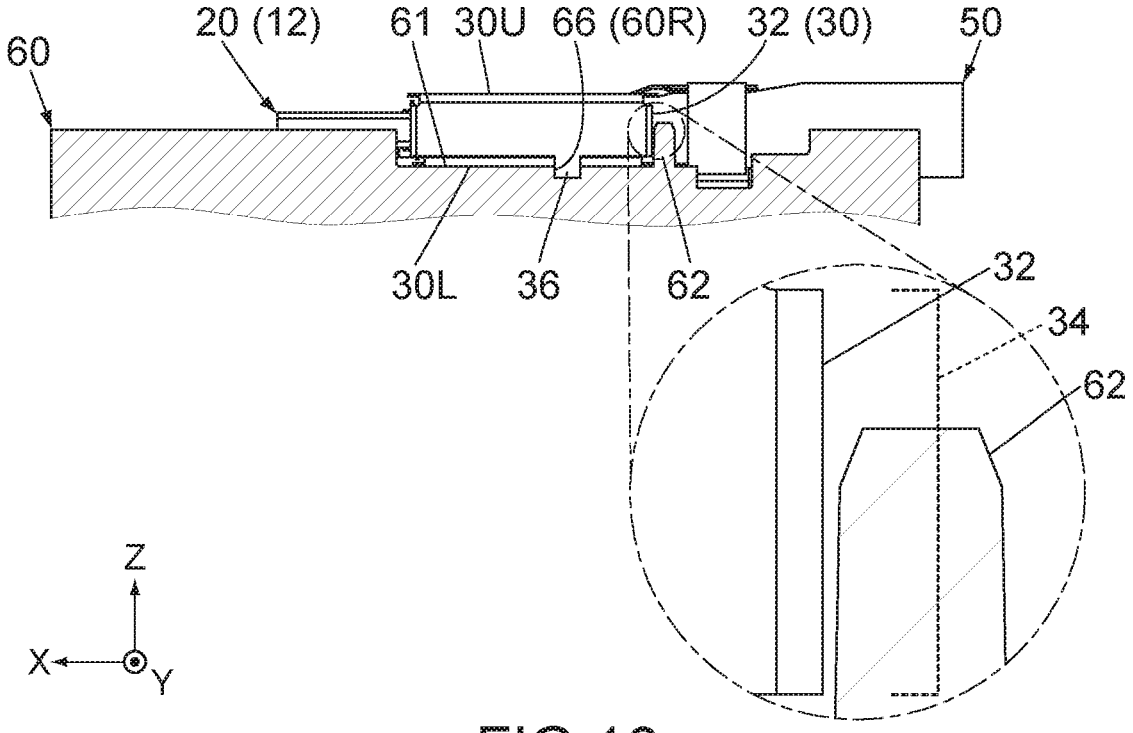
FIG. 16 is a view showing a cross-section of the lower die of FIG. 15, taken along line XVI-XVI, together with a side surface of the intermediate structure of FIG. 15, wherein a part of the intermediate structure and a part of the lower die are enlarged and illustrated, and in the enlarge view, an outline of the hidden second positioning portion is illustrated with dashed line.

Referring to FIGS. 11 to 13, the receiving portion 60R of the present embodiment is formed with two cylindrical pins, namely a first pin 62 and a second pin 64. Each of the first pin 62 and the second pin 64 extends upward slightly beyond the upper surface 60U from the bottom surface 61. The first pin 62 is located forward of the second pin 64. Referring to FIGS. 15 and 16, when the connector body 20 is received in the receiving portion 60R in the proper arrangement, the first pin 62 is located in a space behind the first positioning portion 32, and the second pin 64 is located in a space behind the second positioning portion 34.

When the connector body 20 is received in the receiving portion 60R in the proper arrangement, the first pin 62 of the present embodiment is brought into contact with the first positioning portion 32 in the X-direction or is located just behind the first positioning portion 32 with a slight distance from the first positioning portion 32. Meanwhile, the second pin 64 of the present embodiment is brought into contact with the second positioning portion 34 in the X-direction or is located just behind the second positioning portion 34 with a slight distance from the second positioning portion 34. The first pin 62 and the second pin 64 which are arranged as described above position the intermediate structure 12 in the X-direction together with the first positioning portion 32 and the second positioning portion 34. More specifically, the first pin 62 and the second pin 64 regulate a rearward movement of the intermediate structure 12. Meanwhile, a forward movement of the intermediate structure 12 is regulated by a front end surface of the receiving portion 60R.

Each of the first positioning portion 32 and the second positioning portion 34 has an L-like shape in the XY-plane and thereby works as a spring before the cable-holding portion 41 (see FIG. 1) is formed. When the intermediate structure 12 is moved rearward upon the insertion of the intermediate structure 12 into the receiving portion 60R, the first positioning portion 32 and the second positioning portion 34 are brought into abutment with the first pin 62 and the second pin 64, respectively, and are resiliently deformed. The first positioning portion 32 and the second positioning portion 34 which has been resiliently deformed push the intermediate structure 12 back forward. Thus, the first positioning portion 32 and the second positioning portion 34 of the present embodiment can reliably position the intermediate structure 12 in the X-direction. However, the present invention is not limited thereto. For example, each of the shapes of the first positioning portion 32 and the second positioning portion 34 can be modified as necessary.

Referring to FIG. 15, the connector body 20 of the present embodiment is provided with the two positioning portions consisting of the first positioning portion 32 and the second positioning portion 34. The first positioning portion 32 and the second positioning portion 34 of the present embodiment are located at opposite sides of the connector body 20 in the Y-direction, respectively. This arrangement can more reliably position the connector body 20. However, the present invention is not limited thereto, but the number and the arrangement of the positioning portions can be modified as necessary.

Referring to FIG. 14, the upper die 70 has a lower surface 70L. The lower surface 70L is located at a lower end (negative Z-side end) of the upper die 70 and extends along the XY-plane. The upper die 70 is formed with an upper receiving portion (not shown). The upper receiving portion is a recess which is recessed upward from the lower surface 70L. The upper receiving portion has a shape which can entirely receive an upper part of the intermediate structure 12. When the upper die 70 is moved downward toward the lower die 60 after the insertion of the intermediate structure 12 into the receiving portion 60R in the proper arrangement, the upper part of the intermediate structure 12 is received in the upper receiving portion. The lower surface 70L of the upper die 70 which receives the intermediate structure 12 is brought into contact with the upper surface 60U of the lower die 60. As a result, the intermediate structure 12 is covered by the upper die 70 and the lower die 60.

After the intermediate structure 12 is covered by the upper die 70 and the lower die 60, liquid material such as thermosetting resin is poured into the receiving portion 60R and the upper receiving portion (not shown) through an injection hole (not shown) formed in the upper die 70. The thus-poured material is hardened to form the mold member 40 (see FIG. 1) including the cable-holding portion 41 (see FIG. 1). As a result, the harness 10 (see FIG. 1) is fabricated. Then, the upper die 70 is detached, and the fabricated harness 10 is taken out of the lower die 60.

The cable-holding portion 41 (see FIG. 1) of the present embodiment is formed by using the two dies consisting of the upper die 70 and the lower die 60. Thus, the number of the dies of the present embodiment is two. However, the present invention is not limited thereto, but the number of the dies may be three or more. For example, when the cable-holding portion 41 is formed, an additional die (not shown) may be used in addition to the lower die 60 and the upper die 70. For example, the additional die may be formed with a receiving recess which can receive the fit portion 22. The intermediate structure 12 may be received in the lower die 60 together with the additional die in which the fit portion 22 is received.

Referring to FIG. 9, when the connector body 20 is arranged in an upside-down arrangement in which the connector body 20 is arranged upside-down, the fit portion 22 has an outline which is same as the outline of the fit portion 22 in the proper arrangement of the connector body 20. The outline of the base portion 28 in the upside-down arrangement of the connector body 20 is different from but is similar to the outline of the base portion 28 in the proper arrangement of the connector body 20. Thus, the outline of the connector body 20 in the upside-down arrangement is similar to the outline of the connector body 20 in the proper arrangement.

Referring to FIG. 16, even if a lower surface of the lower plate 30L of the shell 30 (hereafter, referred to as "predetermined surface") faces upward upon insertion of the intermediate structure 12 into the receiving portion 60R of the lower die 60, an operator of the intermediate structure 12 might misunderstand that the predetermined surface faces downward. Referring to FIG. 14, if the connector body 20 is received in the lower die 60 in the upside-down arrangement in which the predetermined surface faces upward, the connector body 20 might be damaged during the downward movement of the upper die 70 toward the lower die 60. Even if the physical shape of the connector body 20 in the upside-down arrangement is same as the physical shape of the connector body 20 in the proper arrangement, the connector body 20 sometimes should not be arranged in the upside-down arrangement because of some reasons such as asymmetrical pin assignment of the terminals (not shown) of the fit portion 22.

Referring to FIG. 15, the intermediate structure 12 and the lower die 60 of the present embodiment have a reverse arrangement prevention mechanism for preventing the aforementioned upside-down arrangement. The reverse arrangement prevention mechanism of the present embodiment is formed of the second positioning portion 34 of the intermediate structure 12 and the first pin 62 of the lower die 60. Hereafter, explanation will be made about the reverse arrangement prevention mechanism of the present embodiment.

Referring to FIGS. 15 and 16, when the connector body 20 is properly arranged, i.e. when the connector body 20 is under the proper arrangement, the first pin 62 of the lower die 60 is, at least in part, located at a position same as that of the second positioning portion 34 of the shell 30 in the X-direction. In addition, the first pin 62 is, at least in part, located at a position same as that of the second positioning portion 34 in the Z-direction.

Figure 17:
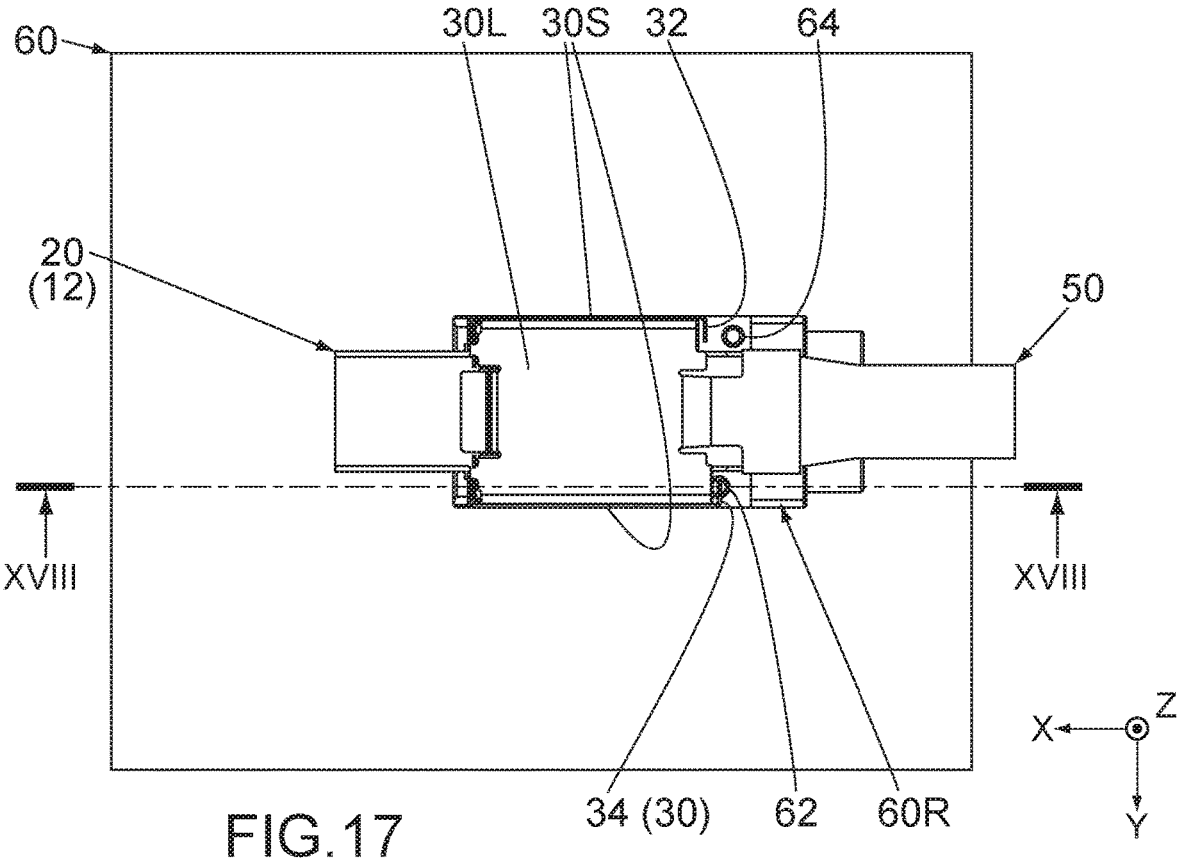
FIG. 17 is another top view showing the intermediate structure and the lower die of FIG. 15, wherein the intermediate structure is arranged upside-down.
Figure 18:
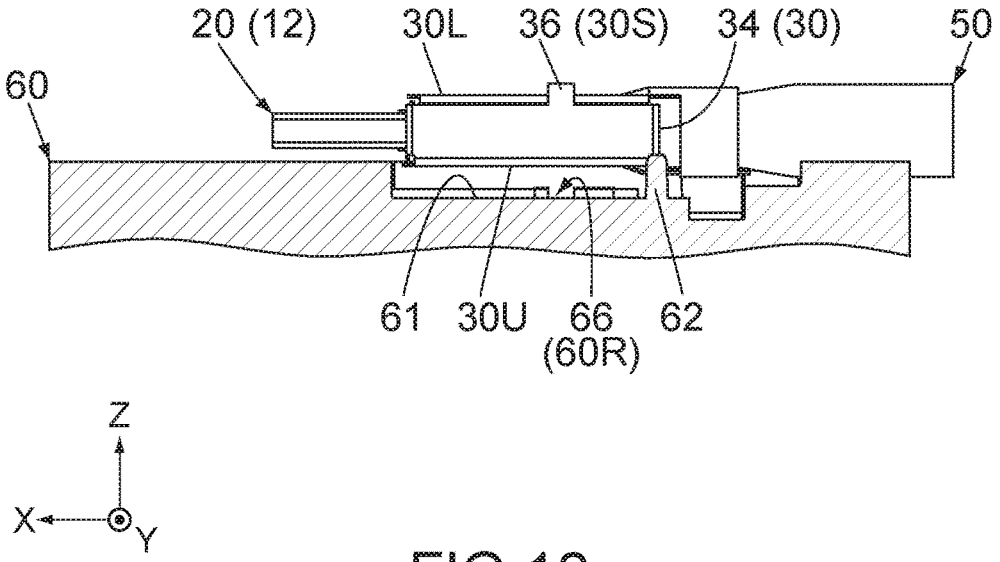
FIG. 18 is a view showing a cross-section of the lower die of FIG. 17, taken along line XVIII-XVIII, together with a side surface of the intermediate structure of FIG. 17.
Figure 19:
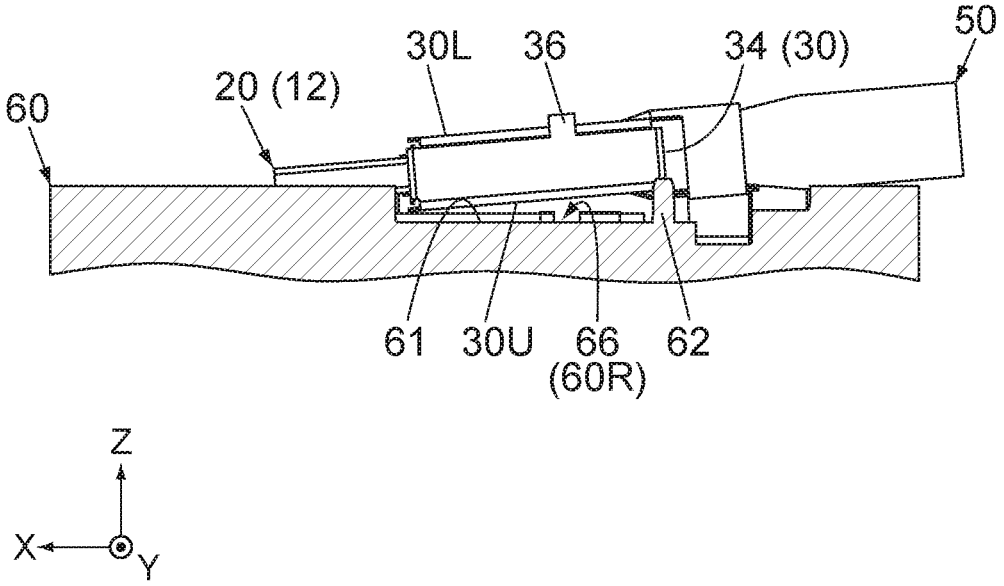
FIG. 19 is another view showing the intermediate structure and the lower die of FIG. 18.
Figure 20:
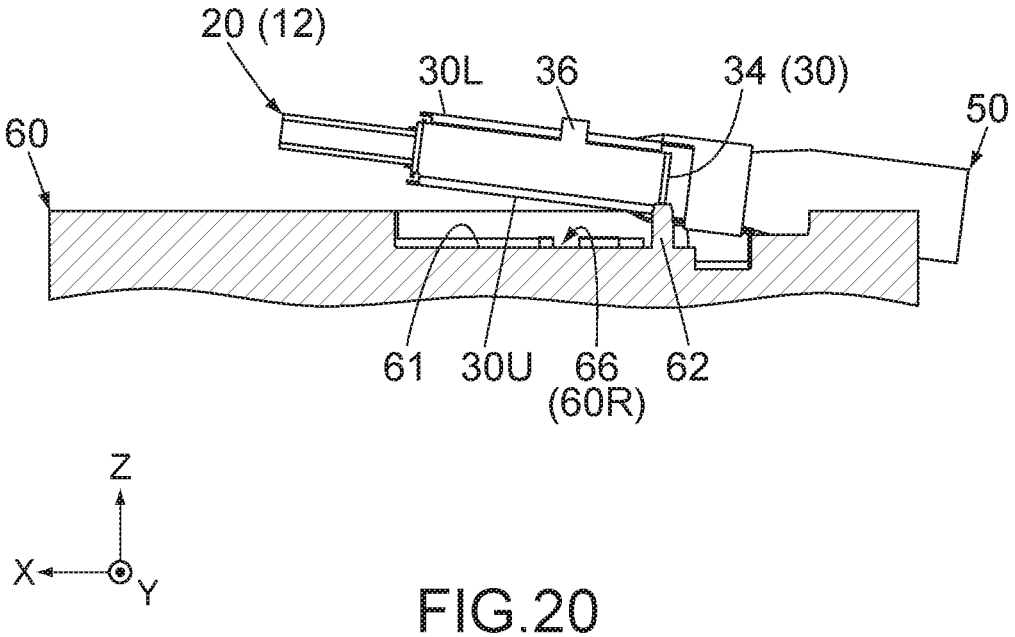
FIG. 20 is still another view showing the intermediate structure and the lower die of FIG. 18.

Referring to FIGS. 17 and 18, upon an attempt to insert the connector body 20 into the receiving portion 60R of the lower die 60 in the upside-down arrangement, a lower end of the second positioning portion 34 is brought into abutment with an upper end of the first pin 62. As a result, the intermediate structure 12 cannot be inserted to a proper position of the receiving portion 60R and is lifted up from the receiving portion 60R. Referring to FIGS. 19 and 20, even if the intermediate structure 12 under the upside-down arrangement changes its posture, the intermediate structure 12 is, at least in part, lifted up from the receiving portion 60R. Therefore, the operator of the intermediate structure 12 can visually recognize that the connector body 20 is in the upside-down arrangement.

Referring to FIGS. 11 and 14, the reverse arrangement prevention mechanism can be theoretically formed even if the lower die 60 is not provided with a projecting portion such as the first pin 62. For example, the reverse arrangement prevention mechanism can be theoretically formed of the projections 36 of the intermediate structure 12 and the bottom surface 61 of the lower die 60. According to this theoretical reverse arrangement prevention mechanism, the upper die 70 should be formed with indents which can receive the projections 36 while the lower die 60 need not be formed with the indents 66. According to this instance, the proper arrangement of the present embodiment is the upside-down arrangement.

According to the modification described above, when the connector body 20 is in the upside-down arrangement, lower ends of the projections 36 are brought into abutment with the bottom surface 61, and thereby the intermediate structure 12 is partially lifted up from the receiving portion 60R. However, each of the projections 36 of the present embodiment projects from the lower plate 30L only by a slight projecting length. For example, the projecting length is about 0.5 mm. Therefore, this reverse arrangement prevention mechanism makes it difficult to visually recognize whether the intermediate structure 12 is lifted up or not. If the projecting length of each of the projections 36 is made longer to be similar to that of the first pin 62, it can be visually recognized that intermediate structure 12 is lifted up. However, when the projections 36 are made longer, the connector body 20 of the harness 10 (see FIG. 1) will have an unnecessary large size in the Z-direction. Therefore, such modification is impractical. Practically, the reverse arrangement prevention mechanism should include projecting portions such as the first pin 62 provided to the lower die 60.

Referring to FIGS. 2 and 11, as described below, the reverse arrangement prevention mechanism of the present embodiment can be seen from the structure of the harness 10.

In the present embodiment, the first recessed portion 42 of the cable-holding portion 41 is a mark where the first pin 62 of the lower die 60 is pulled out. The second recessed portion 44 of the cable-holding portion 41 is a mark where the second pin 64 of the lower die 60 is pulled out. Therefore, the shapes of the first recessed portion 42 and the second recessed portion 44 correspond to the shapes of the first pin 62 and the second pin 64, respectively. In addition, the arrangement of the first recessed portion 42 and the second recessed portion 44 in the XY-plane is identical to the arrangement of the first pin 62 and the second pin 64 in the XY-plane.

Figure 4:
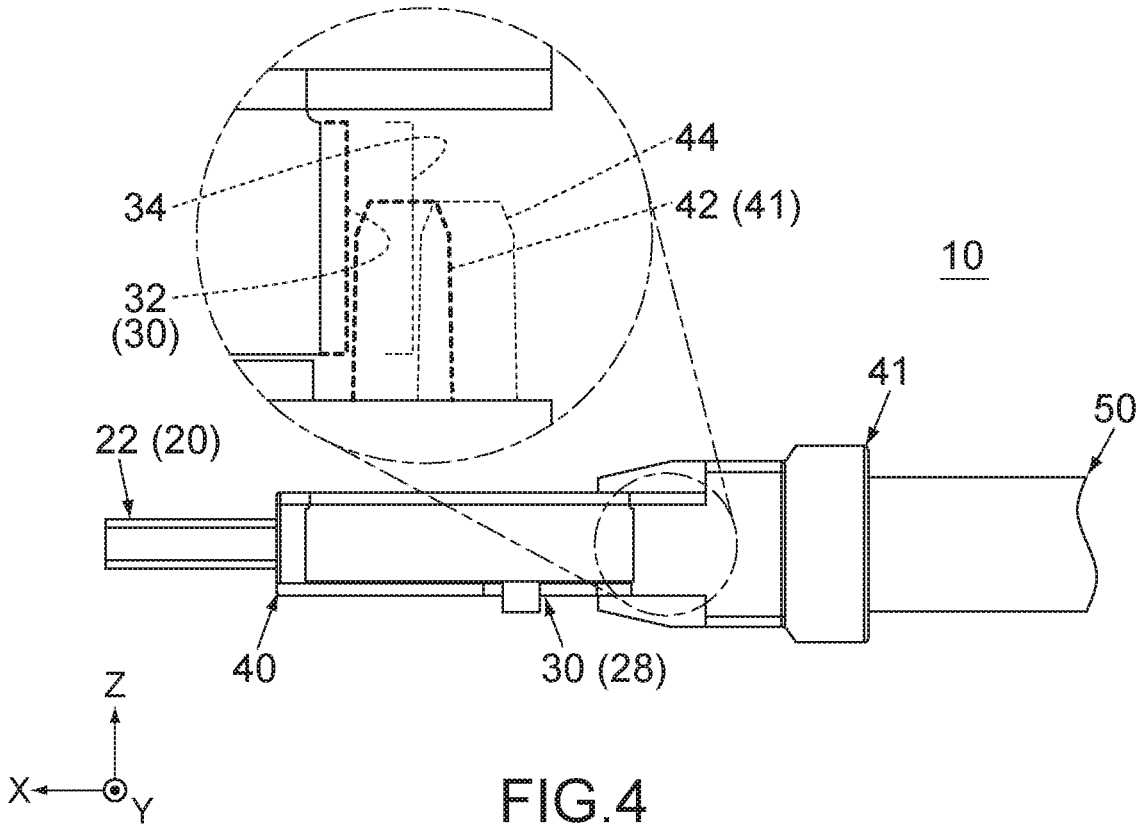
FIG. 4 is a side view showing the harness of FIG. 1, wherein a part of the harness enclosed by chain dotted lines is enlarged and illustrated, and in the enlarged view, an outline of a hidden first recessed portion, an outline of a hidden second recessed portion, an outline of a hidden first positioning portion and an outline of a hidden second positioning portion are illustrated with dashed line.
Figure 5:
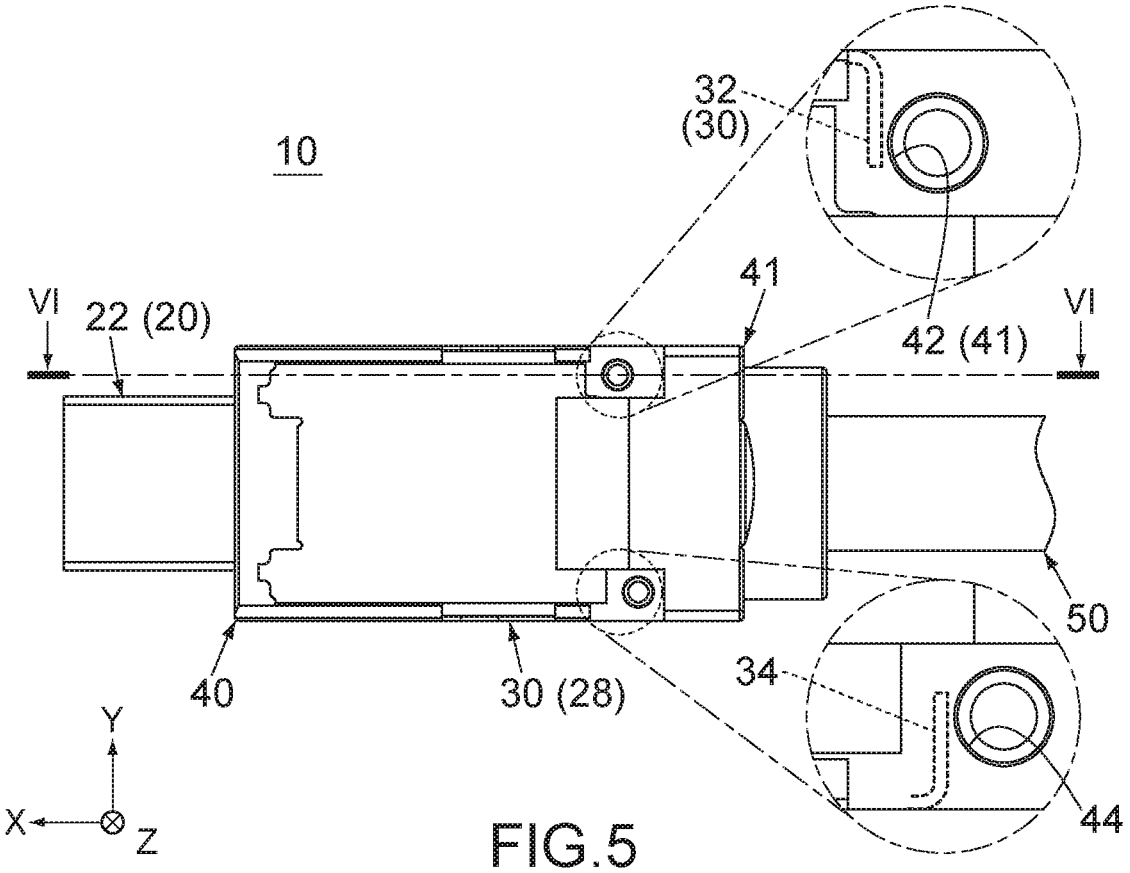
FIG. 5 is a bottom view showing the harness of FIG. 1, wherein two parts of the harness each enclosed by chain dotted lines are enlarged and illustrated, and in each of the enlarged views, an outline of the hidden first positioning portion or an outline of the hidden second positioning portion is illustrated with dashed line.

Referring to FIGS. 4 and 5, the first recessed portion 42 is located forward of the second recessed portion 44. The first recessed portion 42 is located rearward of the first positioning portion 32 of the shell 30. The second recessed portion 44 is located rearward of the second positioning portion 34 of the shell 30. The first recessed portion 42 is, at least in part, located at a position same as that of the second positioning portion 34 in the X-direction. In addition, the first recessed portion 42 is, at least in part, located at a position same as that of the second positioning portion 34 in the Z-direction.

Referring to FIGS. 17 and 18, the second positioning portion 34 of the present embodiment is an interference portion which forms the reverse arrangement prevention mechanism together with the first pin 62. Thus, referring to FIG. 5, the base portion 28 of the connector body 20 has the interference portion 34. Referring to FIGS. 2, 17 and 18, the first recessed portion 42 of the present embodiment is a recessed portion which corresponds to the first pin 62 of the reverse arrangement prevention mechanism. Thus, the cable-holding portion 41 is formed with the recessed portion 42. The recessed portion 42 opens at least downward in the Z-direction.

Referring to FIGS. 4 and 5, the recessed portion 42 and the interference portion 34 are located at opposite sides of the harness 10 in the Y-direction, respectively. The recessed portion 42 is, at least in part, located at a position same as that of the interference portion 34 in the X-direction. In addition, the recessed portion 42 is, at least in part, located at a position same as that of the interference portion 34 in the Z-direction. Referring to FIG. 10, when the connector body 20 is turned upside-down, the thus-arranged interference portion 34 is moved to a position at which the recessed portion 42 is, at least in part, located previously.

Referring to FIGS. 17 and 18, if the intermediate structure 12 is arranged upside-down upon formation of the cable-holding portion 41 (see FIG. 1), the interference portion 34 is brought into abutment with the first pin 62 of the lower die 60, and the connector body 20 is lifted up from the lower die 60. Thus, according to the present embodiment, the only one interference portion 34 provided on the connector body 20 enables visual inspection upon formation of the cable-holding portion 41 on whether the connector body 20 is arranged upside-down or not. As described above, the present embodiment can provide the harness 10 having a structure which is simple and enables a visual inspection on whether the connector body 20 is properly arranged or not upon formation of the cable-holding portion 41.

Referring to FIG. 18, in order to visually recognize whether the connector body 20 is lifted up from the lower die 60 or not, the height of the first pin 62 from the bottom surface 61 should be a predetermined length or more. In the present embodiment, the height, i.e. the size in the Z-direction, of the connector body 20 is about 4 mm. In this instance, the height of the first pin 62 from the bottom surface 61 is preferred to be equal to or more than 2 mm. Therefore, referring to FIG. 6, the recessed portion 42 is preferred to have a depth DP of 2 mm or more in the Z-direction. However, the present invention is not limited thereto. For example, the height of the connector body 20 of the present invention is not specifically limited. The depth DP of the recessed portion 42 in the Z-direction is preferred to be at least equal to or more than 2 mm regardless of the height of the connector body 20.

Referring to FIGS. 4 and 5, hereafter, further specific explanation will be made about the first recessed portion 42, the second recessed portion 44, the first positioning portion 32 and the second positioning portion 34 of the present embodiment.

Referring to FIG. 10, each of the first recessed portion (recessed portion) 42, the second recessed portion 44, the first positioning portion 32 and the second positioning portion (interference portion) 34 of the present embodiment is located between the opposite sides of the connector body 20 in the Y-direction. More specifically, the position of each of the first recessed portion 42, the second recessed portion 44, the first positioning portion 32 and the second positioning portion 34 in the Y-direction is located between those of the two side plates 30S in the Y-direction. This arrangement enables visual inspection on whether the connector body 20 is properly arranged or not while the harness 10 is not increased in size in the Y-direction. However, the present invention is not limited thereto. For example, each of the first positioning portion 32 and the second positioning portion 34 may protrude outward from the corresponding side plate 30S in the Y-direction.

Referring to FIG. 10, the second positioning portion 34 of the present embodiment is located rearward of the first positioning portion 32 and works as the interference portion. However, the present invention is not limited thereto. For example, the first positioning portion 32 may be located rearward of the second positioning portion 34. In this instance, the first positioning portion 32 is the interference portion, and the second recessed portion 44 is the recessed portion.

Referring to FIGS. 17 and 18, the present embodiment enables visual recognition on whether the connector body 20 is lifted up from the lower die 60 or not with no increase of components. More specifically, the present embodiment enables the aforementioned visual recognition by using one of the two positioning portions consisting of the first positioning portion 32 and the second positioning portion 34 as the interference portion. However, the present invention is not limited thereto. For example, the two positioning portions may be provided as necessary. When the two positioning portions are not provided, a rear end of one of the side plates 30S of the shell 30 may be used as the interference portion.

Referring to FIG. 5, each of the first recessed portion 42 and the second recessed portion 44 opens only downward. However, the present invention is not limited thereto. For example, referring to FIG. 13, each of the first pin 62 and the second pin 64 may further extend upward. In addition, referring to FIG. 4, each of the further-extending first recessed portion 42 and the second recessed portion 44 may pass through the cable-holding portion 41 in the Z-direction. In other words, each of the first recessed portion 42 and the second recessed portion 44 may open upward and downward. Thus, each of the first recessed portion 42 and the second recessed portion 44 may open at least downward.

Referring to FIG. 11, the second pin 64 may be provided on the upper die 70 (see FIG. 14). The-thus provided second pin 64 may extend downward. Referring to FIG. 4, the second recessed portion 44 of this modification may open only upward. Thus, the second recessed portion 44 may open at least one of upward and downward. Moreover, when the two positioning portions consisting of the first positioning portion 32 and the second positioning portion 34 are not provided, the second pin 64 need not be provided. In other words, the second recessed portion 44 may be provided as necessary.

Referring to FIG. 5, each of the first recessed portion 42 and the second recessed portion 44 of the present embodiment has a circular shape in the XY-plane and is not exposed outward from the cable-holding portion 41 in the Y-direction. In other words, each of the first recessed portion (recessed portion) 42 and the second recessed portion 44 is closed in the XY-plane defined by the X-direction and the Y-direction. However, the present invention is not limited thereto. For example, the recessed portion 42 may be a groove which has a rectangular shape in the XY-plane. This groove may open downward. In addition, this groove may open outward in the Y-direction from one of opposite sides of the cable-holding portion 41.

More specifically, referring to FIG. 11, the lower die 60 may be provided with a block having a rectangular parallelepiped shape instead of the first pin 62. This block may extend inward in the Y-direction from one of two wall surfaces which are located at opposite sides of the receiving portion 60R in the Y-direction, respectively. However, referring to FIG. 5, when the cable-holding portion 41 is formed with the groove which opens in the Y-direction, the cable-holding portion 41 might be degraded in strength. The present embodiment is preferable from a viewpoint of maintaining the strength of the cable-holding portion 41.

Referring to FIGS. 4 and 5, each of the first positioning portion 32 and the second positioning portion 34 of the shell 30 is buried and fixed in the cable-holding portion 41. Referring to FIG. 8, each of the first positioning portion 32 and the second positioning portion 34 has an L-like shape in the XY-plane and thereby partially blocks the inside of the shell 30 from behind. Thus, each of the first positioning portion 32 and the second positioning portion 34 electromagnetically shields the inside of the shell 30 from behind. In addition, each of the first positioning portion 32 and the second positioning portion 34 strengthens the cable-holding portion 41. For example, when the cable 50 receives a rearward force, the first positioning portion 32 and the second positioning portion 34 prevent the connector body 20 from being removed from the cable 50.

The present embodiment can be further variously modified in addition to the already described various modifications.

Figure 21:
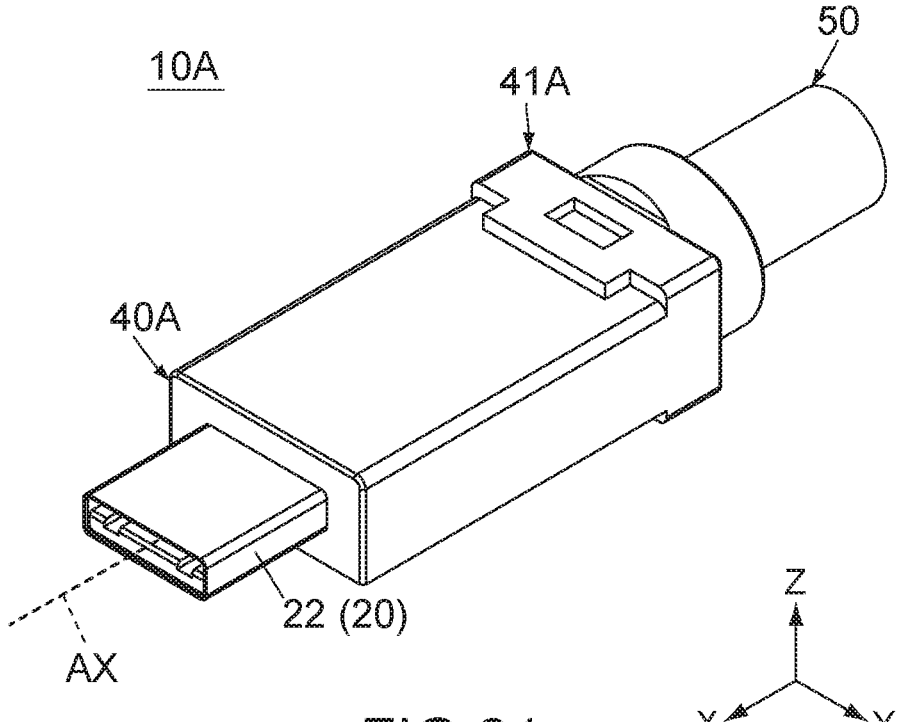
FIG. 21 is a perspective view showing a modification of the harness of FIG. 1, wherein an imaginary central axis of a connector body is illustrated with dashed line.
Figure 22:
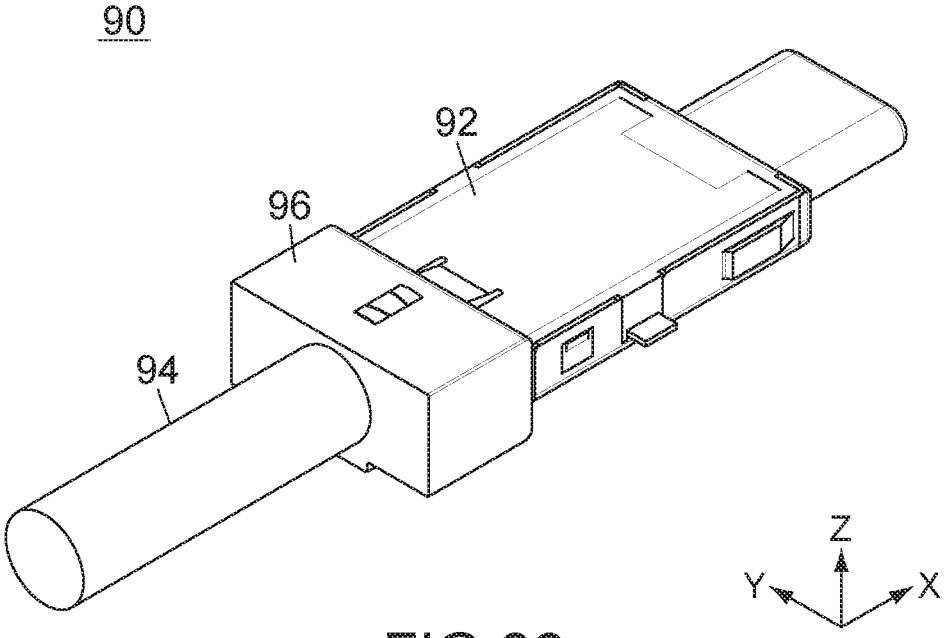
FIG.22 PRIOR ART
FIG. 22 is a perspective view showing a harness of Patent Document 1.

For example, comparing FIG. 21 with FIG. 1, a harness 10A according to a modification comprises the connector body 20 and the cable 50 same as those of the harness 10 but comprises a mold member 40A different from the mold member 40 of the harness 10. The mold member 40A entirely covers the shell 30 (see FIG. 1). The mold member 40A has a rear part which works as a cable-holding portion 41A similarly to the cable-holding portion 41.

What is claimed is:

1. A harness configured to be connected to an object, wherein:

the harness comprises a connector body, a cable and a cable-holding portion;

the connector body comprises a base portion and a fit portion;

the fit portion projects forward in a front-rear direction from the base portion and is mateable with the object along the front-rear direction;

the cable is connected to the connector body;

the cable has an end portion and a main portion;

the end portion is received in the base portion;
the main portion extends rearward from the end portion;
the cable-holding portion is formed so as to extend across the base portion and the main portion and holds the cable;
the cable-holding portion is formed with a recessed portion;
the recessed portion opens at least downward in an upper-lower direction perpendicular to the front-rear direction;
the base portion of the connector body has an interference portion;
the recessed portion and the interference portion are located at opposite sides of the harness, respectively, in a lateral direction perpendicular to both the front-rear direction and the upper-lower direction;
the recessed portion is, at least in part, located at a position same as that of the interference portion in the front-rear direction;
the recessed portion is, at least in part, located at a position same as that of the interference portion in the upper-lower direction
the cable-holding portion is formed with a first recessed portion and a second recessed portion;
the first recessed portion opens at least downward;
the second recessed portion opens at least one of upward and downward;
the first recessed portion is located forward of the second recessed portion;
the base portion of the connector body has a first positioning portion and a second positioning portion;
the first positioning portion is located forward of the second positioning portion;
the first recessed portion is located rearward of the first positioning portion;
the second recessed portion is located rearward of the second positioning portion;
the first recessed portion is, at least in part, located at a position same as that of the second positioning portion in the front-rear direction;
the first recessed portion is, at least in part, located at a position same as that of the second positioning portion in the upper-lower direction;
the first recessed portion is the recessed portion; and
the second positioning portion is the interference portion.

2. The harness as recited in claim 1, wherein each of the recessed portion and the interference portion is located between opposite sides of the connector body in the lateral direction.

3. The harness as recited in claim 1, wherein the second recessed portion opens at least downward.

4. The harness as recited in claim 1, wherein:
the base portion of the connector body comprises a shell;
the cable-holding portion is formed so as to extend across the shell and the main portion of the cable; and
each of the first positioning portion and the second positioning portion is a part of the shell and works as a spring before the cable-holding portion is formed.

5. The harness as recited in claim 1, wherein the recessed portion is closed in a plane defined by the front-rear direction and the lateral direction.

6. The harness as recited in claim 1, wherein the fit portion of the connector body has a 180-degree rotationally symmetrical outline with respect to a central axis extending along the front-rear direction.

7. The harness as recited in claim 1, wherein the recessed portion has a depth of 2 mm or more in the upper-lower direction.

8. A harness configured to be connected to an object, wherein:
the harness comprises a connector body, a cable and a cable-holding portion;
the connector body comprises a base portion and a fit portion;
the fit portion projects forward in a front-rear direction from the base portion and is mateable with the object along the front-rear direction;
the cable is connected to the connector body;
the cable has an end portion and a main portion;
the end portion is received in the base portion;
the main portion extends rearward from the end portion;
the cable-holding portion is formed so as to extend across the base portion and the main portion and holds the cable;
the cable-holding portion is formed with a recessed portion;
the recessed portion opens at least downward in an upper-lower direction perpendicular to the front-rear direction;
the base portion of the connector body has an interference portion;
the recessed portion and the interference portion are located at opposite sides of the harness, respectively, in a lateral direction perpendicular to both the front-rear direction and the upper-lower direction;
the recessed portion is, at least in part, located at a position same as that of the interference portion in the front-rear direction;
the recessed portion is, at least in part, located at a position same as that of the interference portion in the upper-lower direction; and
the recessed portion has a depth of 2 mm or more in the upper-lower direction.

9. The harness as recited in claim 8, wherein each of the recessed portion and the interference portion is located between opposite sides of the connector body in the lateral direction.

10. The harness as recited in claim 8, wherein the recessed portion is closed in a plane defined by the front-rear direction and the lateral direction.

11. The harness as recited in claim 8, wherein the fit portion of the connector body has a 180-degree rotationally symmetrical outline with respect to a central axis extending along the front-rear direction.

* * * * *